US005087527A

United States Patent [19]

Shimura et al.

[11] Patent Number: 5,087,527

[45] Date of Patent: Feb. 11, 1992

[54] THERMAL TRANSFER RECORDING MEDIUM

[75] Inventors: Ryouchi Shimura; Motoo Tasaka, both of Susono; Minoru Hakiri, Numazu; Youji Ide, Mishima, all of Japan

[73] Assignee: Ricoh Company, Ltd., Tokyo, Japan

[21] Appl. No.: 473,045

[22] Filed: Jan. 31, 1990

Related U.S. Application Data

[63] Continuation-in-part of Ser. No. 247,450, Sep. 22, 1988, abandoned.

[30] Foreign Application Priority Data

Sep. 24, 1987 [JP] Japan ..... 62-240369

[51] Int. Cl.[5] ..... B41M 5/26

[52] U.S. Cl. ..... 428/488.4; 428/195; 428/484; 428/522; 428/913; 428/914

[58] Field of Search ..... 428/195, 212, 484, 488.1, 428/488.4, 690, 913, 522, 914

[56] References Cited

U.S. PATENT DOCUMENTS 5,002,819 3/1991 Tohma et al. ..... 428/488.4

*Primary Examiner*—Pamela R. Schwartz

*Attorney, Agent, or Firm*—Oblon, Spivak, McClelland, Maier & Neustadt

[57] ABSTRACT

A thermal transfer recording medium possesses an ink layer. The ink layer comprises a first thermally fusible material layer stacked on one surface of a heat resistant supporting material, at least one second thermally fusible material layer stacked on the first thermally fusible material layer, and a third thermally fusible material layer stacked on the second thermally fusible material layer. An elongation rate of the second thermally fusible material layer at 20° C. is higher than the respective elongation rates of the first and third thermally fusible material layers at 20° C.

15 Claims, 1 Drawing Sheet

THERMAL TRANSFER RECORDING MEDIUM

CROSS-REFERENCE TO RELATED APPLICATION

The present application is a continuation-in part of application Ser. No. 07/247,450 filed Sept. 22, 1988, now abandoned.

BACKGROUND OF THE INVENTION

This invention relates to a thermal transfer recording medium for recording in such a manner that thermally fusible ink is transferred to a transfer material by using a thermal head.

A thermal transfer recording method has been widely used as a method of easily recording onto a plain paper (transfer paper). However, the quality of the printed characters can easily depend upon the smoothness of the surface of the transfer paper. It is, therefore, difficult to clearly print characters on the transfer paper which is inferior in surface smoothness. In order to overcome this problem, the following methods have previously been proposed: a method in which heat treatment is carried out after printing has been completed (Japanese Patent Application Laid-Open (KOKAI) No. 58-76276); a method in which a supplementary means such as a masgnetic force (Japanese Patent Application Laid-Open (KOKAI) No. 52-96549) or static electrical force (Japanese Patent Application Laid-Open (KOKAI) No. 55-65590) is used when the transfer is performed; a method in which a great quantity of oily material is added into an ink so as to lower the melt viscosity of ink at the time of performing transfer (Japanese Patent Application Laid-Open (KOKAI) No. 60-25762); and a method in which a heat-decomposable material (Japanese Patent Application Laid-Open (KOKAI) No. 60-82389) or a thermally expandable material (Japanese Patent Application Laid-Open (KOKAI) No. 60-25762) is added to the ink so as to improve sensitivity to heat. Further, a method for improving the quality of printed characters by using a multilayered thermally fusible ink-layer has been proposed. For example, there are proposed a method in which thermally fusible inks faving slightly different fusing temperatures each other are laminated in the form of layers and pigment is added to at least one of the layers (Japanese Patent Application Laid-Open (KOKAI) No. 59-224392), a method in which a layer of a thermally fusible material which does not contain coloring material is formed on the thermally fusible ink layer (Japanese Patent Application Laid-Open (KOKAI) No. 60-97888).

However, in the case of the above-described recording methods in which ink having been fused to become a liquid are transferred onto the paper, the quality of the characters printed on the paper with poor surface smoothness is insufficient as compared with that of characters printed on the paper with high surface smoothness. For this reason, the problem involved in the thermal transfer recording method, that is to say, the defect that the quality of the printed characters depends upon the smoothness of the paper surface onto which the characters are to be transferred, cannot be satisfactorily dissolved.

On the other hand, high quality printed characters can be obtained on a paper sheet which is inferior in surface smoothness by using ink mainly composed of a resin showing a tackness and having a certain mechanical strength without becoming a liquid with a low viscosity when the thermal energy is applied thereto, so that the ink adheres to convex portions on the surface of the paper sheet and covers concave portions on the surface of the paper sheet.

However, since the use of such a resin ink described above requires a high energy as compared with conventional wax-type inks, in the case where the resin ink is used, a film exhibiting an excellent heat resistance needs as a supporting film and, in addition problems concerning the life of the thermal head and concerning heat accumulation arise.

It is known that a releasing layer is disposed under a resin ink layer for improving the sensitivity of the resin ink, such releasing layer being made of a material such as wax which can be easily fused.

A thermal transfer recording medium having such a structure is known as a bridge transfer-type recording medium. In bridge transfer, the critical factor is the timing of separating the thermal transfer recording medium from the transfer paper onto which characters are transferred by the application of energy for performing transfer. In the case where this timing is late and as a result, the releasing layer to be separated and the ink layer have cooled down, a problem thus arises that if the adherence of ink to the paper is weak, the ink returns to the thermal transfer recording medium, so that transfer can not be achieved. On the other hand, a further problem arises that the sharpness is impaired because the separation of the ink in the printed portion causes the separation of the ink located at other portions where no printing is to be performed (this phenomenon is referred to as "accompanied transfer").

A line printer which prints character lines one by one by using a line head exhibits high recording speed. However, the timing of separating the thermal transfer recording medium from the paper after application of energy for performing printing is late as compared with the timing in serial printers which prints characters one by one. Therefore, it is difficult to print by using a bridge-type thermal transfer recording medium which is designed for use in a serial printer.

As a result of the inventors' studies in order to solve the above-mentioned problems, it has been found that as an ink layer of a thermal transfer recording medium, by using an ink layer comprising:

a first thermally fusible material layer stacked on one surface of a heat resistant supporting material;

at least one second thermally fusible material layer stacked on a surface of the first thermally fusible material layer which is opposite to a surface of the first thermally fusible layer facing to the supporting material; and a third thermally fusible material layer stacked on a surface of the second thermally fusible material layer which is opposite to a surface of the second thermally fusible layer facing to the supporting material, wherein an elongation rate of the second thermally fusible material layer at 20° C. is higher than the respective elongation rates of the first and third thermally fusible material layers at 20° C., a clear and correct recording can be obtained on a transfer paper which is poor in surface smoothness. Based on this finding, the present invention has been attained.

SUMMARY OF THE INVENTION

An object of the present invention is to provide a thermal transfer recording medium which can clearly perform recording to a transfer paper which is poor in surface smoothness, by using a line printer which can perform high speed recording.

In an aspect of the present invention, there is provided a thermal transfer recording medium having an ink layer, the ink layer comprising:

a first thermally fusible material layer stacked on one surface of a heat resistant supporting material;

at least one second thermally fusible material layer stacked on a surface of the first thermally fusible material layer which is opposite to a surface of the first thermally fusible layer facing to the supporting material; and a third thermally fusible material layer stacked on a surface of the second thermally fusible material layer which is opposite to a surface of the second thermally fusible layer facing to the supporting material;

wherein an elongation rate of the second thermally fusible material layer at 20° C. is higher than the respective elongation rates of the first and third thermally fusible material layers at 20° C.

In an other aspect of the present invention, there is provided a thermal transfer recording medium comprising an ink layer and a heat resistant supporting material, the ink layer comprising;

a first thermally fusible material layer containing a wax having a melting point of 55° C. or higher, stacked on one surface of the heat resistant supporting material;

at least one second thermally fusible material layer containing as a major component a thermal softening resin comprising ethylene vinyl acetate copolymer, ethylene ethylacrylate copolymer or a mixture thereof which on average contains 65% or more of ethylene and has a number average molecular weight of 20,000 or less, and a coloring material, stacked on a surface of the first thermally fusible material layer which is opposite to a surface of the first thermally fusible layer facing the heat resistant supporting material; and a third thermally fusible material layer which is compatible with thermally fusible material of the second thermally fusible material layer stacked on a surface of the second thermally fusible material layer which is opposite to a surface of the said second thermally fusible layer facing the heat resistant supporting material, an elongation rate of the second thermally fusible material layer at 20° C. being higher than the respective elongation rates of the first and third thermally fusible material layers at 20° C.

The thermal transfer recording medium according to the present invention is in principle constructed by two layers of wax material having low melt viscosity and low elongation, and a layer having a heat softening properties and high elongation, which is sandwiched by the said two layers. As far as the basic characteristics of each layer is maintained, layers may be further superposed therebetween or thereon, or coloring material or pigment may be added to the respective layers.

When the bridge-transfer is performed by a line printer, it is critical that the adhesive strength of the ink to paper to which characters are transferred is improved, so that the ink is correctly separated at the boundary portion between the portion in which a signal is present and the portion in which any signal is not present.

An embodiment of the present invention is characterized by a thermal transfer recording medium comprising a second thermally fusible material layer containing a coloring material and/or fluorescent dyestuff, the second layer being sandwiched between a first thermally fusible material layer which is proximate to a supporting material and a third thermally fusible material layer which becomes proximate to the paper to which characters are to be transferred at the time of recording.

Another embodiment of the present invention is characterized by a thermal transfer recording medium in which a first thermally fusible material layer proximate to the supporting material contains 51 wt. % or more of fluorescent dyestuff in the whole of ink layers, and a second thermally fusible material layer contains 51 wt. % or more of coloring material in the whole of ink layers.

A further embodiment of the present invention is characterized by a thermal transfer recording medium in which the second thermally fusible material layer is divided into two layers wherein a second thermally fusible material layer (A) which is proximate to the supporting material contains 51 wt. % or more of the fluorescent dyestuff in the whole of ink layers and a second thermally fusible material layer (B) which is more away from the supporting material contains 51 wt. % of the coloring material in the whole of ink layers.

A still further embodiment of the present invention is characterized by a thermally fusible transfer recording medium comprising four layers in which the second thermally fusible material layer is divided into two layers, wherein an elongation rate at 20° C. of a second thermally fusible layer (A) 2*a* which is the layer closer to the supporting material is higher than that of a second thermally fusible material layer (B) 2*b* which is more away from the supporting material, of a first thermally fusible material layer 1 proximate to the supporting material, and of a third thermally fusible material layer 3 which becomes proximate to the paper to be transferred at the time of recording, the said second thermally fusible material layer (A) 2*a* containing 51 wt. % or more of a fluorescent dyestuff in the form of solid a solution, and the said second thermally fusible material layer (B) 2*b* containing 51 wt. % or more of the coloring material.

The 3 layers-type thermal transfer recording medium according to the present invention can perform clear and correct recording on the transfer paper which is poor in surface smoothness without involving blurs of characters and lack of sharpness by using a line printer which enables high speed recording. Furthermore, it can be applied to ink having strong fluorescent intensity.

DESCRIPTION OF THE PREFERRED EMBODIMENTS

Figure 1:
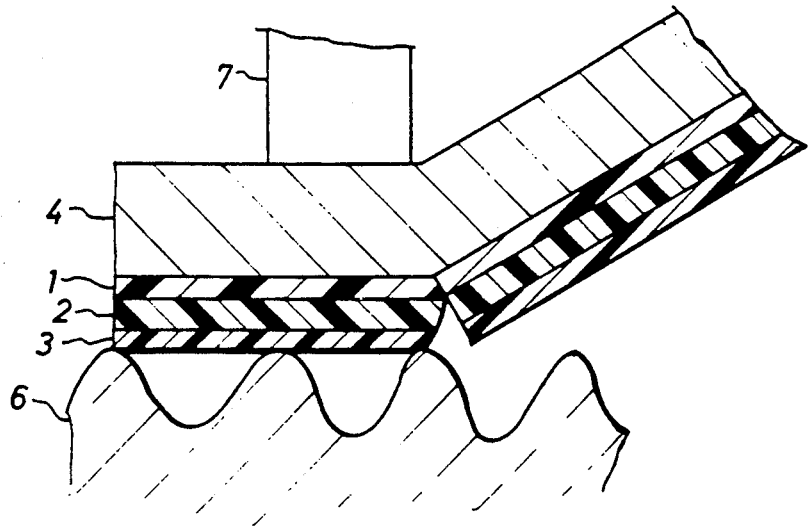
FIG. 1 illustrates a thermal transfer recording medium according to the present invention on which characters are printed in a bridge-transfer method.
Figure 2:
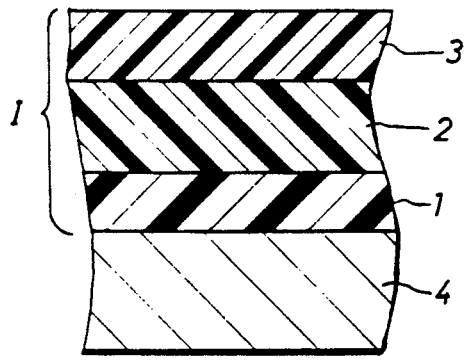
FIG. 2 illustrates an example of the thermal transfer recording medium having an ink layer constructed with three layers according to the present invention.

The layers of the thermal transfer recording medium according to the present invention will be in detail described.

(i) It is effective for improving the adhesive strength to the transfer paper, to equip a wax-like material layer having the low melt viscosity as a third thermally fusible material layer 3 so as to be located closest to the paper to which characters are transferred at the time of recording. The third thermally fusible material layer 3 according to the present invention acts to improve the adhesive strength. The material for use in the third thermally fusible material layer 3 is composed of, as its major component, a wax-like material which is compatible, when it is heated, to thermally fusible material of a second thermally fusible material layer such as ethylene ethyl acrylate copolymer and/or ethylene vinyl acetate copolymer. As a wax-like material, natural wax such as carnauba wax, candelilla wax, rice wax, beeswax, paraffin wax and microcrystalline wax; various synthetic wax such as denatured paraffin wax; low molecular weight polyethylene; polyethylene oxide; polycaprolactones; higher fatty acid esters; amides; metallic salts; wool wax, wool waxes modified by polyhydric alcohol such as ethylene glycol, glycerol, etc; and copolymer of $\alpha$-olefin and maleic anhydride may be exemplified.

Resins or pigments may be added for reinforcing the layer, and the amount thereof needs to be restricted not more than 60 wt. % based on the whole third thermally fusible material layer. Furthermore, it is preferred that the third thermally fusible material layer 3 as the top layer which is located closest to the transfer paper at the time of recording, has the melting point (in a temperature rising test at constant speed under a pressure of 1 kg/cm$^2$ and a rising speed of 1° C./minute with Flow Tester CFT500 manufactured by Shimazu Seisakusho, the intersection of the base line of the flow curve and the extension of the rising portion of the maximum flow is made the melting point) of not lower than 50° C. and not higher than 85° C. In addition, it is preferred that the melt viscosity (with a Brook field type viscometer) at 100° C. is 5,000 cps or lower. If the melting point is lower than 50° C., a problem such as blocking or the like can easily occur. If it is higher than 85° C., the sensitivity is low and great energy is needed to perform printing. The third thermally fusible material layer having a melting point of higher than 85° C. is not suitable for practical use. If the melt viscosity is higher than 5,000 cps, the effect of the third thermally fusible material layer 3 closest to the transfer paper 6, which improves its adhesive strength is reduced. Furthermore, it is desirable for the third thermally fusible material layer 3 to have an overall thickness of 0.5 to 5.0 μm regardless of it being formed by single layer or multilayers.

The third thermally fusible material layer 3 as the top layer may be formed by the same material as that for the first thermally fusible material layer 1 closest to the supporting material 4. It is advantageous to use, as the material for the third thermally fusible material layer, a wax having lower melt viscosity and lower melting point than those of the material used for the first thermally fusible material layer 1 closest to the supporting material 4 for obtaining more excellent sensitivity at recording. It is also advantageous that the third thermally fusible material layer 3 as the top layer does not contain colored coloring material for preventing contamination at recording.

(ii) A thermally fusible material for use in the second thermally fusible material layer 2 as the intermediate layer contains, as its major components, a thermosoftening resin, and a layer that containing a coloring material is preferred. It is necessary for this thermosoftening resin to have enough strength in order to ensure the bridge-transfer performance for the purpose of covering the concave portion on the paper onto which characters are to be transferred. However, it is necessary not to cause the "accompanied transfer" in the no-signal portion. For this reason, it is preferable that 80 wt. % or more of the thermally fusible material in the second thermally fusible material layer 2 is ethylene vinyl acetate copolymer and/or ethylene ethyl acrylate copolymer which exhibits the elongation rate of 200% to 800% at 20° C. and the tensile strength of 5 to 25 kg/cm$^2$ at 20° C. A still further preferable thermally fusible material is ethylene vinyl acetate copolymer and/or ethylene ethyl acrylate copolymer having an average ethylene content of 65% or more and a number average molecular weight of 20,000 or less.

Furthermore, there are available resins such as polyamide resins and styrene butadiene resins. A wax may be added to the intermediate layer. However, if the quantity of the wax exceeds a certain level, the resin performance are impaired and the recording performance onto the paper which lacks the surface smoothness becomes poor.

The elongation rate at 20° C. is measured under JIS K6766-1966, and the tensile strength at 20° C. is measured under JIS K6766-1966.

If the average ethylene content is less than 65%, the elongation rate becomes too large, the transfer of ink onto paper becomes imperfect, and the characters transferred can be easily made incomplete. If the number average molecular weight exceeds 20,000, the elongation rate and the tensile strength becomes too large, whereby "accompanied transfer" easily occurs. Furthermore, if the elongation rate becomes too small due to the excessive addition of wax, the covering effect performed by the bridge of the thermally fusible material is reduced, and as a result, insufficient printing of characters occurs and the solid image cannot be sufficiently reproduced.

It is preferable for the number average molecular weight of the whole thermally fusible material of the second thermally fusible material layer 2 to be greater than that of the thermally fusible materials of the first thermally fusible material layer 1 closest to the supporting material 4 and of the third thermally fusible material layer 3 which becomes closest to the transfer paper 6 at the time of recording.

It is suitable for the thickness of this second thermally fusible material layer 2 to be 1 to 5 μm. This layer 2 is an ink layer containing mainly the colored pigment, and if necessary, contains a fluorescent dyestuff. This layer 2 of a resin component is divided into two layers which may be arranged in such a manner that the second thermally fusible material layer (B) **2*b* closer to the transfer paper 6 may contain the colored pigment, while the second thermally fusible material layer (A) 2*a* closer to the supporting material 4** may contain the fluorescent dyestuff.

(iii) The first thermally fusible material layer 1 closest to the supporting material 4 is an thermosensitive adhesive layer, if necessary, containing the fluorescent dyestuff. It is instantaneously melted in a signal portion and is in part dissolved each other with the thermally fusible material of the second thermally fusible material layer 2, and as a result the adhesive strength of the first thermally fusible material layer is reduced so that the first layer acts as the separation layer, while the first thermal fusible material layer has an action of adhering the thermosoftening material layer to the supporting material 4 in the no-signal portion. For this reason, the first thermally fusible material layer 1 closest to the supporting material 4 is made of a material having such characteristics that if has great adhesive strength at room temperatures, and is instantaneously melted, at the time when the temperature of the first layer is raised, and dissolved each other with the thermosoftening material of the second thermally fusible material layer 2. It is the most preferable for such material to be paraffin wax and/or microcrystalline wax. Furthermore, a denatured wax obtained from the above-described paraffin wax or the microcrystalline wax and having the melting point (measured with the flow tester method) of 55° C. or higher may be used. If the melting point is lower than 55° C., the adhesive strength is not sufficient. As the other component of the first thermally fusible material layer 1 closest to the supporting material 4 extender pigments, resins, oils and the like are properly added. However, the quantity added thereof is lower than 50 wt. % of the thermally fusible material layer 1. If it is not more than 50 wt %, the separating performance of the second thermally fusible material layer 2 in the signal portion is deteriorated.

When the thermal transfer recording medium according to the present invention is stacked to the transfer paper 6 under a certain pressure and thermal energy is applied to the thermal transfer recording medium from the reverse side of the supporting material 4, the first and the third thermally fusible material layers 1 and 3 which are mainly composed of wax and sandwich the second thermally fusible material layer 2 are fused and are gradually dissolved into this intermediate layer 2. Consequently, the adhesive strength of the first thermally fusible material layer to the supporting material 4 is reduced, and the thermal transfer recording medium is strongly adhered to the transfer paper 6 which has a relatively large surface area. Next, when the recording medium is separated from the transfer paper 6, the ink layer corresponding to the signal portion is transferred to the paper 6 even if the recording medium is cooled down, while the ink layer corresponding to the no-signal portion is allowed to remain on the supporting material 4 so that printing is performed. The summary of the function of the thermal transfer recording medium having the ink layer I composed of three layers according to the present invention is as follows: first, the first thermally fusible material layer 1 closest to the supporting material 4 acts as an adhesive layer, and if necessary, contains a fluorescent dyestuff. When heat is applied at the time of printing, the first thermally fusible material layer 1 is in part dissolved into and absorbed by the intermediate second thermally fusible material layer 2, and the adhesive strength of the first thermally fusible material layer corresponding to the printing portion is made lower than that corresponding to the non-printing portion.

The intermediate second thermally fusible ink layer 2 serves as the fluorescent ink and/or colored pigment ink layer and as well has the function as the bridge transfer layer, so that it acts to cover the concave portions on the surface without smoothness.

The third thermally fusible material layer 3 as the top layer acts to, when printing is performed, assist the adhesion of the transfer paper 6 to the ink layer which is stacked below the former, and it as well acts to prevent contamination due to rubbing in a case where any colored pigment is not contained.

The function of the thermal transfer recording medium having the ink layer I composed of four layers according to the present invention is as follows: first, the first thermally fusible material layer 1 acts as an adhesive layer. When heat is applied at the time of printing, the first thermally fusible material layer 1 closest to the supporting material 4 is in part dissolved into and absorbed by a thermally fusible ink layer 2*a* as the second thermally fusible material layer (A), and the adhesive strength of the recording medium corresponding to the printing portion is made lower than that corresponding to the non-printing portion.

The thermally fusible ink layer 2*a* is the fluorescent ink layer and as well has the function as the bridge transfer layer, so that it acts to cover the concave portions on the surface without smoothness.

The thermally fusible ink layer 2*b* as the second thermally fusible material layer (B) acts as the colored ink layer and as well it has the function as a bridge transfer layer.

This up-and-down positional relationship between the ink layer 2*a* and the ink layer 2*b* is inverted when the transfer has been performed to the transfer paper 6. Since the fluorescent ink layer 2*a* which contains the solid solution of the fluorescent dyestuff and emits strong fluorescence, becomes a layer closer to the surface of the recorded pattern, sufficient fluorescent strength can be obtained.

The third thermally fusible material layer 3 acts to assist adhesion of the transfer paper 6 to the ink layer stacked below the former, and as well it acts to prevent contamination due to rubbing in a case where colored pigment is not contained.

A heat resistant layer 5 may be disposed on the reverse side of the thermal transfer recording medium according to the present invention for the purpose of improving heat resistance and transporting performance of the recording medium. The material used for achieving this object may be exemplified by a lubricant heat-resistant material such as silicon resin, fluorocarbon resin, silicon oil and silicon rubber, and butylal resin and acryl resin cross-linked by heat or active radiant rays. The thickness of the heat resistant layer is preferable to be 0.01 to 5 μm. A method of coating it can be exemplified by known industrial coating method such as bar coater method.

The thermal transfer recording medium according to the present invention may preferably be applied to a case of use of a fluorescent ink having the function which prevents forgery or alternation.

The fluorescent ink used in the present invention is a solid solution of a fluorescent dyestuff. The solid solution of a fluorescent dyestuff is obtained by dissolving a fluorescent dyestuff into a resin and/or wax-like substance. When it is applied to the recording medium according to the present invention, such solid solution is pulverized into fine particles having the mean diameter of 10 μm or less. A wax-like substance or a resin used in such solid solution can be selected from substances having a polar group such as amide group, ester group, hydroxyl group, lactone group, and acryl group and having the affinity with the fluorescent dyestuff. Such substances may be exemplified by monoethanol amides of a long chain fatty acid; esters such as sorbitan, glycerine, pentaerythritol or the like of a long chain fatty acid; polycaprolactones; melamine resin; acryl resin; and polyamide resin. On the other hand, a fluorescent dyestuff for coloring the above-described wax-like substance or resin can be exemplified by: thioflavine (CI49005); basic yellow HG (CI46040); fluorescein (CI45350); rhodamine B (CI45170); rhodamine 6G (CI45160); niocin (CI15380); general white fluorescent brightener such as CI fluorescent brightening agents 85, 166 and 174; substance obtained by oil-solubilizing (and simultaneously insolubilizing) the above-described fluorescent dyestuffs with an organic acid such as Oil Pink #312 prepared by oil-solubilizing rhodamine B, Barifast Red 1308 prepared by oil-solubilizing the rhodamine 6G (Manufactured by Orient Chemistry); and substance prepared by lake formation from the above-described fluorescent dyestuff and a metallic salt or another precipitating agent such as Fast ROSE and Fast Rose Conc prepared by lake formation of the rhodamine 6G (manufactured by Dainichiseika Colour & Chemical Mfg. Co., Ltd.).

A method of preparing the solid solution according to the present invention by using the above-described substances can be exemplified by block resin pulverization method, emulsion polymerization method, and resin precipitation method. The block resin pulverization method is the more preferable. The block resin pulverization method (U.K. Patent No. 545462) is a method in which a resin and fluorescent dyestuff are melted and mixed, thereafter the thus produced product is cooled down to be solidified, and then the thus obtained block is pulverized. The emulsion polymerization method (U.K. Patent No. 822709) is a method in which an emulsion polymerized resin powder is added into a hot aqueous solution of fluorescent dyestuff to absorb the dyestuff into the resin powder, and then the thus obtained product is filtered and dried. The resin precipitation method is a method in which an aqueous solution of water soluble metallic salt such as $Al_2(SO_4)_3 \cdot 6H_2O$ is added into an aqueous solution dissolving a water soluble salt of resin and a fluorescent dyestuff to react these substances, the thus formed liquid is, if necessary, acidified to precipitate the dissolved resin in the form of a metallic salt which adheres the fluorescent dyestuff, and then the thus precipitated product is filtered and dried. The thus-obtained solid solution increases its fluorescence intensity as the concentration of the fluorescent dyestuff increases. If this concentration exceeds a certain level, the fluorescence intensity is decreased due to density quenching. Therefore, it is preferable for the ratio of the fluorescent dyestuff contained in the solid solution to be 0.1 to 5.0 wt. %.

A dyestuff or pigment used as the coloring agent in the present invention may be usual materials in this field. That is, as the dyestuff, following oil soluble dyestuffs can be employed: Sumikaron Violet RS, Dianix Fast Violet 3R-FS, and Kayaron Polyol Brilliant Blue-N-BGM (anthraquinone dye); Kayaron Polyol Brilliant Blue BM, Kayaron Polyol Dark Blue 2BM, Sumikaron Diazo Black 5G, and Mictacel Black 5GH (azo dye); Direct Dark GreenB, Direct Brown M, and Direct Fast Black D (direct dye), Kayanol Milling cyanine 5R (acid dye); and Sumikaril Blue 6G, Aizen Malachite green, rhodamine B, rhodamine 6G, and Victoria Blue (basic dye). On the other hand, the following can be exemplified as the pigment: victoria blue lake, metal-less phthalocyanine, phthalocyanine, fast sky blue, permanent red 4R, brilliant fast scarlet, brilliant carmine BS, permanent carmine FB, lithol red, permanent red F5R, brilliant carmine 6B, pigment scarlet 3B, rhodamine lake B, rhodamine lake T, arizaline lake, fast red, bright red G toner, lionol red CP-A, chrome yellow, zinc yellow chromate, lemon yellow (barium chromate), cadmium yellow, naphthol yellow B, Hansa yellow 5G, Hansa yellow 3G, Hansa yellow G, Hansa yellow A, Hansa yellow RN, Hansa yellow R, benzine yellow, benzine yellow G, benzine yellow GR, permanent yellow NCG, quinoline yellow lake, and fast yellow. From the viewpoint of light resistance, color migration and resistance to dissolution, pigment is preferable. In any case, the quantity of such dyestuff and/or pigment is in the range between 2 and 20 wt % based on the ink layer, and a preferable one is in the range between 5 and 15 wt. % based on the ink layer from the viewpoint of color density and quality of print.

The fluorescent dyestuff and coloring material may be simultaneously added to one layer, but the ratio of the coloring material is less than 20 wt % based on the solid solution of the fluorescent dyestuff.

The present invention will be further specifically described with reference to the following Examples. This invention is not limited to these Examples.

EXAMPLE 1

This example shows an example of a thermal transfer recording medium having an ink layer composed of three layers: a first thermally fusible material layer 1 closest to the supporting material 4; a third thermally fusible material layer 3 which comes closest to the transfer paper 6 at the time of recording; and a second thermally fusible material layer 2 sandwiched between the above-described first thermally fusible material layer 1 and the above-described third thermally fusible material layer 3.

FIG. 1 schematically shows each constituent layer of the recording medium in the case where characters are bridge-transferred onto the transfer paper 6 by applying the thermal head 7 to the thermal transfer recording medium according to the present invention.

[PREPARATION OF THE FIRST THERMALLY FUSIBLE MATERIAL LAYER]

95 parts by weight of paraffin wax (melting point: 155° F.) and 5 parts by weight of carnauba wax were mixed in molten state under heating. The melting point of this mixture was 72° C. in the flow tester method, and the melt viscosity of the mixture was 90 cps at 100° C., and the elongation rate of the mixture was 12% at 20° C. The number average molecular weight of this mixture was approximately 540.

The thus mixed materials were coated by the thickness of 1.5 μm on one side of a polyester film having a thickness of 6 μm by a hot melt coating method to form the first thermally fusible material layer 1.

[PREPARATION OF THE SECOND THERMALLY FUSIBLE MATERIAL LAYER]

An applying ink liquid was obtained by kneading, in a ball mill for 20 hours, 15 parts by weight of coloring carbon black, 65 parts by weight of ethylene ethyl acrylate copolymer (content of ethyl acrylate: 28%, melt index: 275), 15 parts by weight of ethylene vinyl acetate copolymer (content of vinyl acetate: 70%, melt index: 300), 5 parts by weight of lecithin and 500 parts by weight of toluene. The thus obtained ink was coated on the surface of the above-described first thermally fusible material layer 1 with a wire bar to make the dry thickness 3 μm. Next, the thus coated ink was dried at 60° C. to form the second thermally fusible material layer 2. The contents of the ethylene contained by the mixture of the ethylene ethyl acrylate copolymer and the ethylene vinyl acetate copolymer was approximately 70% and the number average molecular weight of the mixture was approximately 15,000. The trensile strength at 20° C. only of the mixture of the ethylene ethyl acrylate copolymer and the ethylene vinyl acetate copolymer was 18 kg/cm$^2$ and the elongation rate at 20° C. of the mixture was 540%. The elongation rate of the solid part of the second thermally fusible material layer 2 at 20° C. was 370%.

[PREPARATION OF THE THIRD THERMALLY FUSIBLE MATERIAL LAYER]

An applying liquid was obtained by kneading, in a ball mill for 20 hours, 7 parts by weight of paraffin wax (melting point: 140° F.), 3 parts by weight of carnauba wax and 100 parts by weight of isooctane. The thus obtained liquid was coated on the surface of the second thermally fusible material layer 2 so as to make the dry thickness 2 μm, as a result of which, the third thermally fusible material was obtained. The melting point of the solid part of the third thermally fusible material layer was 62° C. by the flow tester method, the viscosity of the solid at 100° C. was 38 cps, the elongation rate of the solid part at 20° C. was 28%, and the number average molecular weight of the solid part was approximately 600.

EXAMPLE 2

An applying ink liquid was obtained by kneading, in a ball mill for 20 hours, 10 parts by weight of red organic pigment, 90 parts by weight of ethylene ethyl acrylate copolymer (ethylene content: 75%, melt index: 350) and 500 parts by weight of toluene. The thus obtained liquid was coated by a wire bar on the surface of the first thermally fusible material layer 1 which was obtained in the Example 1 so as to make the dry thickness 4 μm, as a result of which, the second thermally fusible material 2 was obtained. The tensile strength of the ethylene ethyl acrylate copolymer at 20° C. was 16 kg/cm$^2$ and the elongation rate at 20° C. was 600%. The elongation rate of the solid part of the second thermally fusible material layer 2 at 20° C. was 480%, and the number average molecular weight of the second thermally fusible material layer was approximately 15,000.

Next, the third thermally fusible material layer 3 which is the same as in the Example 1 was formed on the thus produced second thermally fusible material layer 2 to prepare the thermal transfer recording medium.

COMPARISON EXAMPLE 1

On the first thermally fusible material layer 1 according to the Example 1, an ink liquid obtained by kneading, in a ball mill for 20 hours, 15 parts by weight of coloring carbon black, 65 parts by weight of ethylene vinyl acetate copolymer (content of ethylene: 28%, melt index: 30), 5 parts by weight of lecithine and 500 parts by weight of toluene was coated so as to make the dry thickness 3 μm, as a result of this, the second thermally fusible material layer 2 was obtained. The tensile strength of this ethylene vinyl acetate copolymer was 50 kg/cm$^2$, the elongation rate of the copolymer was 850%, and the number average molecular weight of the copolymer was approximately 22,000. Similarly to the Example 1, the third thermal fusible material layer 3 was formed on the thus produced second thermally fusible material layer 2 so as to obtain a thermal transfer recording medium to be compared.

COMPARISON EXAMPLE 2

On the first thermally fusible material layer 1 formed in the same manner as in the Example 1, an ink liquid was coated by a wire bar so as to make the dry thickness 3 μm for the purpose of forming the second thermally fusible material ink layer 2 (an ink layer 2) (the elongation rate of this ink layer was 180%), the ink liquid being obtained by kneading, in a ball mill for 20 hours, 15 parts by weight of coloring carbon black, 40 parts by weight of paraffine wax (melting point 155° F.), 40 parts by weight of ethylene vinyl acetate copolymer (content of ethylene: 80%, melt index: 300), 5 parts by weight of lecithine, and 500 parts by weight of toluene. The number average molecular weight of the whole thermally fusible material in the second thermally fusible material layer was approximately 7,500. On the second layer, an ink liquid was coated by a wire bar so as to make the dry thickness 1.5 μm to form the third thermally fusible material layer 3, the ink liquid being obtained by kneading, in a ball mill for 20 hours, 50 parts by weight of paraffine wax (melting point: 155° F.), 50 parts by weight of ethylene vinyl acetate copolymer (content of ethylene 72%, melt index: 150), and 800 parts by weight of isooctane. Thus, a thermal transfer recording medium according to a second comparison example was obtained. The number average molecular weight of the solid part of the third thermally fusible material layer 3 was approximately 9,000, and the elongation rate of the solid part at 20° C. was 300%.

COMPARISON EXAMPLE 3

A thermal transfer recording medium for the comparison was prepared in the same manner as in the Example 1, except that the third thermally fusible material layer 3 was omitted from the constituent layers of the recording medium prepared in the Example 1.

With the thermal transfer recording medium prepared according to the above-described Examples 1 and 2 and the Comparison examples 1 to 3, printing tests were carried out in a printing testing machine on which a line head was mounted under the following printing conditions.

| Printing conditions: | |
|---|---|
| Dot Density | 6 dots/mm |
| Energy | 1 mj/dot |
| Platen Pressure | 1.5 kg/cm$^2$ |
| Printing Speed | 20 mm/sec |
| Paper to be transferred | bond paper sheet whose surface smoothness displays a Bekk value of 3 seconds |
| Separation timing | one second after energy has been applied |

The test results were as follows:

| Thermal transfer recording medium | Contents: Percentage of filled solid in area of 10 mm × 10 mm | Lack in degree of sharpness (accompanied transfer) | blur characters (Deterioration in shape of characters) | Synthetic judgement |
|---|---|---|---|---|
| Example 1 | 100% | not observed | not observed | good |
| Example 2 | 98.5% | not observed | not observed | good |
| Comparison Example 1 | 100% | very large | difficult to read due to excessive lack in sharpness | defective |
| Comparison Example 2 | 66% | not observed | difficult to read due to excessive blur | defective |
| Comparison Example 3 | 42% | not observed | difficult to read due to excessive blur | defective |

As described above, the thermal transfer recording medium according to the Examples 1 and 2 of the present invention showed good printing performance onto bond paper whose surface smoothness displays Bekk value of 3 seconds in the case of performing printing thereon while using a line printer.

If the third thermally fusible material layer 3 as the top layer is not present in the recording medium as shown in the Comparison example 3, sufficient printing cannot be conducted since the major portion of the ink layer which is insufficiently adhered returns to the ribbon.

EXAMPLE 3

90 parts by weight of paraffin wax (melting point 155° F.) and 10 parts by weight of liquid paraffin were mixed in the molten state under heating. Next, a polyester film having the thickness of 6 μm is hot melt-coated with the thus-mixed materials by a thickness of 1.5 μm to form the first thermally fusible material layer 1. The elongation rate of this layer was 20%, the number average molecular weight of the thermally fusible material composed of the above-described materials was approximately 300.

An applying ink liquid was obtained by kneading, in a ball mill for 20 hours at ambient temperature, 22 parts by weight of the solid solution composed of benzyl sulfonic amide-formaldehyde resin and the mixture of Rhodamine B and Extra Rhodamine 6GDN, 6 parts by weight of Lake Red C#405 (Dainichiseika Colour & Chemical Mfg. Co., Ltd.), one part by weight of Seika Fast yellow 2200M (Dainichiseika Colour & Chemical Mfg. Co., Ltd.), 71 parts by weight of ethylene vinyl acetate copolymer (content of ethylene: 75%, melt index: 300), and 600 parts by weight of toluene. The thus-obtained ink liquid was coated on the above-described first thermally fusible material layer 1 by a wire bar, and was dried by hot air at 50° C., to obtain the second thermally fusible material layer 2. The thickness of the thus obtained second thermally fusible material layer 2 alone was 2 μm. The elongation rate of this layer at 20° C. was 300% and the number average molecular weight of the thermally fusible material of this layer was approximately 15,000.

An applying liquid was obtained by kneading, in a ball mill for 20 hours at ambient temperature, 8 parts by weight of paraffin wax (melting point: 140° F.), 2 parts by weight of candelilla wax and 90 parts by weight of isooctane. The thus-obtained liquid is coated on the surface of the second thermally fusible material layer 2 by a wire bar. Next, the thus coated liquid was dried by 50° C. hot air, to form the third thermally fusible material layer 3 on the second layer. The thickness of the third thermally fusible material layer 3 alone was 1.5 μm. The elongation rate of this layer was 15% at 20° C., and the number average molecular weight of the thermally fusible material of this layer was approximately 400.

COMPARISON EXAMPLE 4

An applying liquid was obtained by kneading, in a ball mill for 20 hours at ambient temperature, 22 parts by weight of the solid solution composed of benzyl sulfonic amide formaldehyde resin and the mixture of Rhodamine B and Extra Rhodamine 6GDN, 6 parts by weight of Lake Red C#405 (Dainichiseika Colour & Chemical Mfg. Co., Ltd.), one part by weight of Seika Fast yellow 2200M (Dainichiseika Colour & Chemical Mfg. Co., Ltd.), 71 parts by weight of ethylene vinyl acetate copolymer (content of ethylene: 80%, melt index: 300), 60 parts by weight of paraffin wax (melting point: 140° F.), 15 parts by weight of candelilla wax, and 100 parts by weight of toluene. The thus-obtained liquid is coated on the surface of the first thermally fusible material layer 1 according to the Example 3 so as to make the dry thickness 3.5 μm with a wire bar, and was dried by hot air. Thus, a thermal transfer recording medium according to the comparison example was obtained. The thus obtained thermal transfer recording medium was constructed by two layers. The component of the second layer formed on the first thermally fusible layer 1 was so prepared as to become equal to the total sum of the components of the second and third thermally fusible material layers 2, 3 according to the Example 3.

Next, with these heat sensitive recording medium obtained in the Example 3 and this Comparison Example 4, printing test was conducted in a line-head type printing test machine under the following printing conditions.

| Printing conditions: | |
|---|---|
| Dot Density | 6 dots/mm |
| Energy | 1 mj/dot |
| Platen Pressure | 1.5 kg/cm$^2$ |
| Printing Speed | 40 mm/sec |
| Paper to be transferred | bond paper sheet of 120 μm in thickness whose surface smoothness displays a Bekk value of of 3 seconds |

The test results were as follows:

| Thermal transfer recording medium | Contents: Percentage of filled solid in area of 10 mm × 10 mm | Visual quality under white light | Visual quality under ultraviolet light |
|---|---|---|---|
| Example 3 | 98% | very good | easy to be identified since pattern was shown clearly |

-continued

| Thermal transfer recording medium | Contents: Percentage of filled solid in area of 10 mm × 10 mm | Visual quality under white light | Visual quality under ultraviolet light |
|---|---|---|---|
| Comparison Example 4 | 67% | Characters were shown incompletely, solid was not clear, base was contaminated in the form of dot. | pattern was not clear due to incomplete characters, fine dot pattern was generated due to contamination of base |

EXAMPLE 4

An ink liquid is obtained by kneading, in a ball mill for 20 hours, 40 parts by weight of solid solution composed of benzyl sulfonic amide formaldehyde resin and the mixture of Rhodamine B and Extra Rhodamine 6GDN, 20 parts by weight of candelilla wax, 25 parts by weight of paraffin wax (melting point: 155° F.), 5 parts by weight of liquid paraffin, and 400 parts by weight of toluene. The thus obtained ink liquid is coated on a polyester film having the thickness of 6 μm so as to make the dry thickness 2 μm. Next, the thus coated layer was dried at 80° C. and a first thermally fusible material layer (ink layer) 1 was formed. The number average molecular weight of the thermally fusible material of this layer was approximately 400. An ink liquid was obtained by kneading, in a ball mill for 20 hours, 6 parts by weight of red lake pigment, 1 part by weight of yellow lake pigment, 43 parts by weight of ethylene ethyl acrylate copolymer (content of ethylene: 75%, melt index: 300), and 250 parts by weight of toluene. The thus-obtained ink liquid was coated on the surface of the first thermally fusible material layer 1 with a wire bar so as to make the dry thickness 2 μm. The thus coated layer was dried at 60° C. to form the second thermally fusible material layer 2 on the first thermally fusible material layer. The number average molecular weight of the thermal fusible material of this layer 2 was approximately 15,000. An applying liquid was obtained by kneading in a ball mill for 20 hours, 5 parts by weight of paraffin was, 5 parts by weight of candelilla wax, and 90 parts by weight of isooctane. The thus-obtained liquid was coated on the surface of the second thermally fusible ink layer so as to make the dry thickness 1.5 μm, to form the third thermally fusible material layer (the number average molecular weight of the thermally fusible material approximately 400). Consequently, the thermal transfer recording medium according to the Example 4 in the present invention was obtained.

EXAMPLE 5

90 parts by weight of paraffin wax (melting point: 155° F.) and 10 parts of liquid paraffin were mixed in the molten state while heating these materials at 100° C. The thus obtained mixture was applied to a polyester film having the thickness of 6 μm in a hot-melt coating manner so as to make the thickness 1.5 μm. to form the first thermally fusible material layer 1.

Furthermore, ink liquid was obtained by kneading, in a ball mill at ambient temperature for 20 hours, 22 parts by weight of solid solution composed of benzyl sulfonic amide formaldehyde resin and the mixture of Rhodamine B and Extra Rhodamine 6GDN, 6 parts by weight of red lake pigment, 1 part by weight of yellow lake pigment, 71 parts by weight of ethylene vinyl acetate copolymer (content of ethylene: 80%, melt index: 300), and 100 parts by weight of toluene. The thus-obtained ink liquid was coated on the surface of the first thermally fusible material layer 1 by a wire bar so as to make the dry thickness 4 μm, to form the second thermally fusible material layer 2 (the number average molecular weight of the thermal fusible material of this layer 2: approximately 15,000).

Furthermore, an applying liquid was obtained by kneading, in a ball mill at ambient temperature for 20 hours, 8 parts by weight of paraffin wax (melting point: 140° F.), 2 parts by weight of candelilla wax, and 90 parts by weight of isooctane. The thus-obtained liquid was coated on the second thermally fusible ink layer 2 by a wire bar so as to make the dry thickness 1 μm. The thus obtained product was then dried at 60° C., to thereby form the third thermally fusible material layer 3 (the number average molecular weight of the thermal fusible material approximately 350).

COMPARISON EXAMPLE 5

In the similar manner to that of the Example 4, the first and second thermally fusible material layers were formed. Furthermore, the mixture obtained by heating 10 parts by weight of ethylene vinyl acetate copolymer (content of ethylene: 72%, melt index: 150) and 90 parts by weight of isooctane was cooled down to ambient temperature. The thus obtained mixture is then kneaded in a ball mill for 20 hours to form an applying liquid. The thus obtained liquid is coated on the second thermally fusible material layer 2 by a wire bar so as to make the dry thickness 1 μm, to form the third thermally fusible material layer 3 (the number average molecular weight of the thermally fusible material: approximately 18,000). Thus, the thermal transfer recording medium according to the comparison example was obtained.

The elongation rate of the solid part of each layer of the thermal transfer recording mediums of Examples 4 and 5 and the comparison Example 5 was as follows:

| Thermal transfer recording medium | Elongation rate of the respective layers at 20° C.: First thermally fusible material layer | Second thermally fusible material layer | Third thermally fusible material layer |
|---|---|---|---|
| Example 4 | 5% | 380% | 36% |
| Example 5 | 28% | 300% | 36% |
| Comparison Example 5 | 28% | 300% | 560% |

With the heat sensitive recording media according to the Examples 4 and 5 and the Comparison Example 5, printing test was conducted in the same manner as in the Example 1. The result was as follows:

| Thermal transfer recording medium | Wavelength of fluorescent light (mm) | Relative intensity of fluorescent light | Percentage of filled solid in area of 10 mm × 10 mm | Incomplete characters |
|---|---|---|---|---|
| Example 4 | 602 | 48 | 98% | not observed |
| Example 5 | 602 | 36 | 98% | good, not observed |
| Comparison Example 5 | 602 | 45 | 66% | good, characters |

-continued

| Thermal transfer recording medium | Wavelength of fluorescent light (mm) | Relative intensity of fluorescent light | Percentage of filled solid in area of 10 mm × 10 mm | Incomplete characters |
|---|---|---|---|---|
| | | | | incomplete, contour was not clear |

EXAMPLE 6

Figure 3:
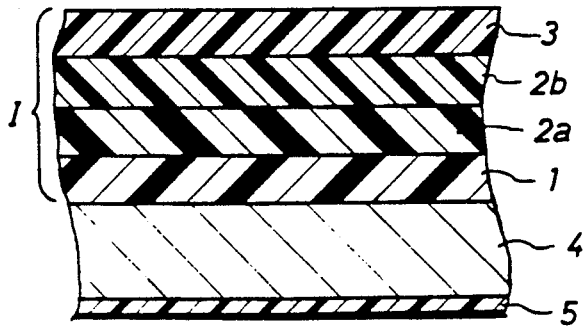
FIG. 3 illustrates an example of the thermal transfer recording medium having an ink layer constructed with four layers according to the present invention.

This example shows an example of a thermal transfer recording medium whose ink layer I is formed by four layers: the first thermally fusible material layer 1 closest to the supporting material 4; the third thermally fusible material layer 3 which becomes closest to the transfer paper 6 at the time of recording; and the second thermally fusible material layer (A) 2a and the second thermally fusible material layer (B) 2b which are disposed between the first thermally fusible material layer 1 and the third thermally fusible material layer 3. In FIG. 3, a heat resistant layer or lubricant layer 5 is disposed on the supporting material 4.

90 parts by weight of paraffin wax (melting point: 155° F.) and 10 parts by weight of liquid paraffin were mixed in the molten state while heating these materials at 100° C. The thus obtained mixture was coated in a hot-melt coating manner on a polyester film having the thickness of 6 μm so as to make the thickness 1.5 μm, to form the first thermally fusible material layer 1 (elongation rate: 12%). The number average of molecular weight of this layer 1 was approximately 400.

40 parts by weight of solid solution composed of benzyl sulfonic amide formaldehyde resin and the mixture of Rhodamine B and Extra Rhodamine 6GDN, 50 parts by weight of ethylene ethyl acrylate copolymer (content of ethylene: 75%, melt index: 300) and 500 parts by weight of toluene were kneaded in a ball mill for 20 hours, to obtain an applying liquid for forming the second thermally fusible material layer (A) 2a. On the other hand, the number average molecular weight of ethylene ethyl acrylate was approximately 15,000.

A liquid for forming the second thermally fusible material layer (B) 2b was obtained by kneading, in a ball mill for 20 hours in a dispersion manner, 12 parts by weight of red lake pigment, 2 parts by weight of yellow lake pigment, 86 parts by weight of ethylene ethyl acrylate copolymer (same as that used in forming the second thermally fusible material layer (A) 2a and 500 parts by weight of isooctane. The thus-obtained liquid for forming the second thermally fusible material layer (A) 2a was first coated on the surface of the first thermally fusible material layer 1 by a wire bar so as to make the dry thickness 1.5 μm, and was dried at 60° C., to form the second thermally fusible material layer (A) 2a (elongation rate: 280%). Furthermore, the liquid for forming the above-described second thermally fusible material layer (B) 2b was coated on the second thermally fusible material layer (A) 2a by a wire bar so as to make the dry thickness 15 μm, and was dried at 60° C., to form the second thermally fusible material layer (B) 2b (elongation rate: 450%).

A liquid for forming the third thermally fusible material layer 3 was obtained by kneading in a ball mill for 20 hours in a dispersion manner, 8 parts by weight of paraffin wax (melting point: 155° F.), 2 parts by weight of candelillar wax, and 90 parts by weight of isooctane. The thus-obtained liquid was coated on the surface of the second thermally fusible ink layer 2b so as to make the dry thickness 1.5 μm, and was dried, to form the third thermally fusible material layer 3 (elongation rate: 25%). As a result, the thermal transfer recording medium according to the present invention was obtained. The number average molecular weight of this layer 3 was approximately 480.

EXAMPLE 7

On the first thermally fusible material layer 1 formed in the same manner as in the Example 6, the second thermally fusible material layers (A) 2a and (B) 2b and the third thermally fusible material layer 3 were formed as follows:

30 parts by weight of solid solution formed from brilliant sulfoflavin and monoethanol amide of coconut oil fatty acid, 25 parts by weight of ethylene vinyl acetate copolymer (content of ethylene: 80%, melt index: 300), 5 parts by weight of ethylene vinyl acetate copolymer (content of ethylene: 90%, melt index: 70), and 240 parts by weight of isooctane were kneaded in a ball mill for 20 hours in a dispersion manner. The thus-obtained material was coated by a wire bar, on the first thermally fusible material layer 1 which had been formed in the same manner as in the Example 6 in such a manner that the dry thickness is 2.5 μm, and then was dried at 60° C., so that the second thermally fusible material layer (A) 2a (elongation rate: 280%) was formed. The number average molecular weight of the thermosoftening component of this layer 2a was approximately 16,000.

Furthermore, 5 parts by weight of blue lake pigment, 1 part by weight of yellow lake pigment, 30 parts by weight of ethylene vinyl acetate copolymer (content of ethylene: 80%, melt index: 300) and 150 parts by weight of isooctane were kneaded in a ball mill for 20 hours in a dispersion manner. The thus-obtained material was coated, by a wire bar, on the second thermally fusible material layer (A) 2a in such a manner that the dry thickness is 1.5 μm, and was dried at 60° C., to form the second thermally fusible material layer (B) 2b (elongation rate: 480%). The number average of molecular weight of the ethylene vinyl acetate copolymer was approximately 15,000.

Furthermore, on this layer 2b, the third thermally fusible material layer 3 was formed in the same manner as in the Example 6, so that the thermal transfer recording medium was obtained.

COMPARISON EXAMPLE 6

Similarly to the Example 6, the first thermally fusible material layer 1, and the second thermally fusible material layers (A) 2a and (B) 2b were formed.

10 parts by weight of ethylene vinyl acetate copolymer (content of ethylene: 72%, melt index: 150), and 90 parts by weight of isooctane were mixed under heating. The thus-mixed material was cooled down, and then dispersed in a ball mill for 20 hours, to obtain an applying liquid. This liquid was coated on the second thermally fusible material layer (B) 2b in such a manner that the dry thickness thereof becomes 1.5 μm, so that the third thermally fusible material layer 3 was formed. As a result, the thermal transfer recording medium according to the Comparison example 6 was obtained. The number average molecular weight of the ethylene vinyl acetate copolymer was approximately 17,000. The elongation rate of the third thermally fusible material layer 3 at 20° C. was 800%.

COMPARISON EXAMPLE 7

On the first thermally fusible material layer 1 which had been formed in the same manner as in the Example 6, a liquid obtained by mixing the liquid for forming the second thermally fusible material layer (A) 2a and the liquid for forming the second thermally fusible material layer (B) 2b which were obtained in the Example 7 in the weight ratio of 5:3 was coated, by a wire bar, in such a manner that the dry thickness becomes 4 μm so that the fluorescent colored ink layer was formed. Furthermore, in the same manner as in forming the third thermally fusible material layer 3 in the Example 6, the third thermally fusible material layer was formed on the above described fluorescent colored ink layer. Thus, the thermal transfer recording medium according to the Comparison example 7 was obtained.

Printing Test

The printing test was carried out by using a printing test machine on which a line head was mounted.

Printing conditions:

| Printing conditions: | |
|---|---|
| Dot Density | 6 dots/mm |
| Energy | 1 mj/dot |
| Platen Pressure | 1.5 kg/cm$^2$ |
| Printing Speed | 40 mm/sec |
| Paper to be transferred | bond paper sheet whose surface smoothness displays 3 seconds of Bekk value |
| Separation timing | one second after energy has been applied |

The test results were as follows

| Thermal transfer recording medium | Visual color under white light | Wave-length of fluo-rescent light | Relative intensity of fluo-rescent light | Percentage of filled solid on area of 10 mm × 10 mm | Incom-plete charac-ters |
|---|---|---|---|---|---|
| Example 6 | Ver-milion | 602 nm | 47.4 | 98% | not, observed good |
| Compar-ison Example 6 | Ver-milion | 604 nm | 32.6 | 66% | observed contour was not clear |
| Example 7 | Bluish green | 504 nm | 18.3 | 97% | not, observed good |
| Compari-son Example 7 | Bluish green | 508 nm | 8.2 | 95% | not, observed good |

Measurement of fluorescent light

Hitachi Fluorescent light spectral meter 650-60 Speed 120 nm/minute; Both slit and excited emission 1 nm

EXAMPLE 3

90 parts by weight of paraffin wax (melting point: 140° F.) and 10 parts by weight of liquid paraffin were mixed in the molten state under heating at 100° C. The thus-mixed material was coated in the hot-melt coating manner on a polyester film having the thickness of 6 μm in such a manner that the thickness becomes 1.5 μm, to form the first thermally fusible material layer 1 (elongation rate: 18%, the number average molecular weight of the thermally fusible material: approximately 400).

An applying liquid was obtained by kneading, in a ball mill for 20 hours, 40 parts by weight of solid solution formed from benzyl sulfonic amide formaldehyde resin and the mixture of Rhodamine B and Extra Rhodamine 6GDN, 50 parts by weight of ethylene ethyl acrylate copolymer (content of ethylene: 75%, melt index: 300) and 50 parts by weight of toluene. The thus-obtained liquid was coated, by a wire bar, on the above-described first thermally fusible material layer 1 in such a manner that the dry thickness becomes 1.5 μm, and then was dried at 60° c., so that the second thermally fusible material layer (A) 2a was formed (elongation rate: 250%, the number average molecular weight of the thermally fusible material: approximately 15,000).

Furthermore, an applying liquid was obtained by kneading, in a ball mill for 20 hours in a dispersion manner, 6 parts by weight of red lake pigment, 1 part by weight of yellow lake pigment, 70 parts by weight of candelilla wax, 16 parts by weight of polyethylene oxide (molecular weight: 1000, acid number: 25), and 500 parts by weight of isooctane. The thus-obtained liquid was coated, by a wire bar, on the second thermally fusible material layer (A) 2a in such a manner that the dry thickness becomes 1.5 μm, and then dried at 60° C., to form the second thermally fusible material layer (B) 2a (elongation rate: 25%, the number average molecular weight of the thermal fusible material: approximately 600).

Furthermore, an applying liquid was obtained by kneading, in a ball mill for 20 hours in a dispersion manner, 8 parts by weight of paraffin wax, 2 parts by weight of candelilla wax, and 90 parts by weight of isooctane. The thus-obtained liquid was coated on the above-described second thermally fusible material layer (B) (ink layer) 2b in such a manner that the dry thickness becomes 1.5 μm, and then dried at 50° C., to form the third thermally fusible material layer 3 (elongation rate: 15%, and the number average molecular weight of the thermally fusible material layer: approximately 400). Thus, the thermal transfer recording medium according to the present invention was obtained.

EXAMPLE 9

On the first thermally fusible material layer 1 formed in the same manner as in the Example 8, the second thermally fusible material layers (A) 2a and (B) 2b and the third thermally fusible material layer 3 were formed as follows.

The following materials were kneaded in a ball mill in a dispersion manner for 20 hours: 30 parts by weight of solid solution formed from monoethanol amide of coconut oil fatty acid and brilliant sulfoflavin, 25 parts by weight of ethylene vinyl acetate copolymer (content of ethylene: 80%, melt index: 300), 5 parts by weight of ethylene vinyl acetate copolymer (content of ethyene: 90%, melt index: 70), and 240 parts by weight of isooctane. The thus-obtained material was coated, by a wire bar, on the first thermally fusible material layer 1 formed in the same manner as in the Example 8 in such a manner that the dry thickness becomes 2.5 μm, and then was dried at 60° C., to form the second thermally fusible material layer (A) 2a (elongation rate: 430%, the number average molecular weight of the thermally fusible material: approximately 17,000).

Furthermore, 5 parts by weight of blue lake pigment, 1 part by weight of yellow lake pigment, 30 parts by weight of candelilla wax and 150 parts by weight of isooctane were kneaded in a ball mill in a dispersion manner. The thus-obtained material was coated by a wire bar, on the above-described second thermally fusible material layer (A) *2a* in such a manner that the dry thickness becomes 1.5 μm, and then was dried at 60° C., to form the second thermally fusible material layer (B) *2b* (elongation rate: 12%, the number average molecular weight of the thermally fusible material: approximately 450).

On this second thermally fusible material layer (B) *2b*, the third thermally fusible material layer 3 was formed in the same manner as in the Example 8, so that the thermal transfer recording medium was obtained.

COMPARISON EXAMPLE 8

In the same manner as in the Example 8, the first thermally fusible material layer 1, and the second thermally fusible material layers (A) *2a* and (B) *2b* were formed.

10 parts by weight of ethylene vinyl acetate copolymer (content of ethylene: 72%, melt index: 150), and 90 parts by weight of isooctane were mixed under heating. The thus-mixed material was cooled down. Next, an applying liquid was obtained by dispersing the thus cooled material in a ball mill for 20 hours. Then, the liquid was coated on the second thermally fusible material layer (B) *2b* in such a manner that the dry thickness becomes 1.5 μm, to form the third thermally fusible material layer 3. Thus, the thermal transfer recording medium according to the comparison Example 8 was obtained. The elongation rate of the third thermally fusible material layer in the recording medium at 20° C. was 800%.

COMPARISON EXAMPLE 9

On the first thermally fusible material layer 1 formed in the same manner as in the Example 8, a liquid obtained by mixing the liquid for forming the second thermally fusible material layer (A) *2a* and the liquid for forming the second thermally fusible material layer (B) *2b* in the ratio by weight of 5:3 was coated, by a wire bar, in such a manner that the dry thickness becomes 4 μm, to form fluorescent colored ink layer (elongation rate: 350% the number average molecular weight of the thermally fusible material: approximately 16,000).

On this fluorescent colored ink layer, the thermally fusible material layer was formed in the same manner as in the case of forming the third thermally fusible material layer 3 in the Example 8. Thus, the thermal transfer recording medium according to the Comparison Example 9 was obtained.

A printing test was performed similarly to the Examples 6 and 7. The results were as follows:

| Thermal transfer recording medium | Visual color under white light | Wave-length of fluo-rescent light | Result: Relative intensity of fluo-rescent light | Percentage of filled solid on area of 10 mm × 10 mm | Incom-plete charac-ters |
|---|---|---|---|---|---|
| Example 8 | Ver-milion | 602 nm | 47.4 | 98% | not, observed |
| Comparison Example 8 | Ver-milion | 604 nm | 32.6 | 67% | good large lack, observed contour was not clear |
| Example 9 | Bluish green | 504 nm | 18.3 | 98% | not, observed good |
| Comparison Example 9 | Bluish green | 508 nm | 8.2 | 95% | not, observed nearly good |

As described above, the thermal transfer recording medium of three layer type according to the present invention enables clear and correct recording without causing any blur of characters or lack in sharpness (due to accompanied transfer), even if a line printer which can conduct high speed recording is used to paper to be transferred which has poor surface smoothness. Furthermore, it can be applied to an ink having intense fluorescence.

What is claimed is:

1. A thermal transfer recording med comprising an ink layer and a heat resistant supporting material, said ink layer comprising:

a first thermally fusible material layer containing a wax having a melting point of 55° C. or higher, stacked on one surface of said heat resistant supporting material;

at least one second thermally fusible material layer containing as a major component a thermal softening resin comprising ethylene vinyl acetate copolymer, ethylene ethylacrylate copolymer or a mixture thereof which on average contains 65% or more of ethylene and has a number average molecular weight of 20,000 or less, and a coloring material, stacked on a surface of said first thermally fusible material layer which is opposite to a surface of said first thermally fusible layer facing said heat resistant supporting material; and a third thermally fusible material layer which is compatible with thermally fusible material of the second thermally fusible material layer, stacked on a surface of said second thermally fusible material layer which is opposite to a surface of said second thermally fusible layer facing said heat resistant supporting material, an elongation rate of said second thermally fusible material layer at 20° C. being higher than the respective elongation rates of said first and third thermally fusible material layers at 20° C.

2. The thermal transfer recording medium according to claim 1, wherein said second thermally fusible material layer contains fluorescent dyestuff and a coloring material.

3. The thermal transfer recording medium according to claim 1, wherein said first thermally fusible material layer includes 51 wt % or more of total fluorescent dyestuff of said ink layer, and said second thermally fusible material layer includes 51 wt % or more of total coloring material of said ink layer.

4. The thermal transfer recording medium according to claim 1, wherein said second thermally fusible material layer comprises thermally fusible material layers (A) and (B) wherein said layer (A) is stacked on a surface of said first thermally fusible material layer which is opposite to said supporting material, and said layer (B) is stacked between said layer (A) and said third thermally fusible material layer, said layer (A) contains 51 wt. % or more of total fluorescent dyestuff of said ink layer, and said layer (B) contains 51 wt. % or more of total coloring material of said ink layer.

5. The thermal transfer recording medium according to claim 4, wherein an elongation rate of said second thermally fusible material layer (A) at 20° C. is higher than those of said first thermally fusible material layer, said third thermally fusible material layer, and said second thermally fusible material layer (B) at 20° C.

6. The thermal transfer recording medium according to claim 5, wherein said first thermally fusible material layer comprises a paraffin wax, microcrystalline wax or a mixture thereof having a melting point of 55° C. or higher.

7. The thermal transfer recording medium according to claim 5, wherein a principle component of said second thermally fusible material layer (A) is a thermal softening resin having the elongation rate of 200% to 800% at 20° C. and the tensile strength of 5 to 25 kg/cm$^2$ at 20° C.

8. The thermal transfer recording medium according to claim 7, wherein said thermal softening resin is ethylene vinyl acetate copolymer, ethylene ethylacrylate copolymer or a mixture thereof.

9. The thermal transfer recording medium according to claim 8, wherein said second thermally fusible material layer (A) comprises 80 wt. % or more of ethylene vinyl acetate copolymer, ethylene ethylacrylate copolymer or a mixture thereof.

10. The thermal transfer recording medium according to claim 1, wherein said first thermally fusible material layer comprises paraffin wax, micro-crystalline wax or a mixture thereof which has a melting point of 55° C. or higher.

11. The thermal transfer recording medium according to claim 1, wherein a principal component of said second thermally fusible material layer is a thermal softening resin having an elongation rate of 200 to 800% at 20° C. and a tensile strength of 5 to 25 kg/cm$^2$ at 20° C.

12. The thermal transfer recording medium according to claim 11, wherein said second thermally fusible material layer comprises 80 wt. % or more of ethylene vinyl acetate copolymer, ethylene ethylacrylate copolymer or a mixture thereof.

13. The thermal transfer recording medium according to claim 8, wherein the number average molecular weight of said ethylene vinyl acetate copolymer, ethylene ethylacrylate copolymer or a mixture thereof in said second thermally fusible material layer is greater than that of the respective thermally fusible materials in said first and third thermally fusible material layers.

14. The thermal transfer recording medium according to claim 1, wherein said third thermally fusible material layer comprises, as a principle component a material which is at least one member selected from the group consisting of natural waxes, synthetic waxes, low molecular weight polyethylenes, polyethylene oxides, polycaprolactones, higher fatty acid esters, amides, metallic acids, and copolymers of α-olefin and maleic anhydrides.

15. The thermal transfer recording medium according to claim 14, wherein said third thermally fusible material layer has a melting point of 50° C. to 85° C. and a melt viscosity of 5,000 cps or less at 100° C.

* * * * *